US009186695B2

(12) United States Patent
Otruba et al.

(10) Patent No.: US 9,186,695 B2
(45) Date of Patent: Nov. 17, 2015

(54) EXTRUSION APPLICATION SYSTEM

(75) Inventors: Svatoboj Otruba, Ceres, CA (US); Ranbir Singh Claire, Livingston, CA (US)

(73) Assignee: B&H Manufacturing Company, Inc., Ceres, CA (US)

( * ) Notice: Subject to any disclaimer, the term of this patent is extended or adjusted under 35 U.S.C. 154(b) by 7 days.

(21) Appl. No.: 13/075,757

(22) Filed: Mar. 30, 2011

(65) Prior Publication Data

US 2011/0244115 A1 Oct. 6, 2011

Related U.S. Application Data

(60) Provisional application No. 61/319,960, filed on Apr. 1, 2010.

(51) Int. Cl.

| | |
|---|---|
| ***B05D 5/10*** | (2006.01) |
| ***B05C 11/10*** | (2006.01) |
| ***B05C 5/02*** | (2006.01) |
| ***B65C 9/22*** | (2006.01) |
| *B05C 1/16* | (2006.01) |

(52) U.S. Cl.

CPC ..... *B05C 11/1007* (2013.01); *B05C 5/0208* (2013.01); *B05C 5/0258* (2013.01); *B65C 9/2217* (2013.01); *B05C 1/16* (2013.01)

(58) Field of Classification Search

CPC .... B05C 11/1007; B05C 1/16; B05C 5/0258; B05C 5/0208; B05C 9/2217

USPC ..... 427/80; 118/692

See application file for complete search history.

(56) References Cited

U.S. PATENT DOCUMENTS

| | | | | |
|---|---|---|---|---|
| 3,235,433 | A | 2/1966 | Cvacho et al. | |
| 4,056,075 | A | 11/1977 | Seiderman | |
| 4,156,398 | A | 5/1979 | McDaniel | |
| 4,277,301 | A | 7/1981 | McIntyre et al. | |
| 4,371,571 | A | 2/1983 | McIntyre et al. | |
| 4,530,862 | A | 7/1985 | Kerzel | |
| 4,535,919 | A | 8/1985 | Jameson | |
| 4,622,239 | A | 11/1986 | Schoenthaler et al. | |
| 4,682,710 | A | 7/1987 | Turner, Jr. et al. | |
| 4,787,332 | A * | 11/1988 | Geisel et al. | 118/692 |

(Continued)

FOREIGN PATENT DOCUMENTS

| | | |
|---|---|---|
| EP | 0403280 A2 | 12/1990 |
| EP | 1459808 A2 | 9/2004 |

(Continued)

OTHER PUBLICATIONS

Nordson, Wraparound Labeling System, Carousel Magazine-fed Applications, Jan. 2006, pp. 1-2.

(Continued)

*Primary Examiner* — Xiao Zhao

(74) *Attorney, Agent, or Firm* — Wolf, Greenfield & Sacks, P.C.

(57) ABSTRACT

A machine and a method of applying a non-Newtonian liquid composition onto a surface in a controlled manner. The composition is held in a chamber at a controlled variable pressure and is dispensed through a slit die nozzle as controlled by a valve. Characteristics of the composition are empirically developed and provided to a logic control circuit to assure that the composition is dispensed on either the entire surface or in one or more precise locations.

16 Claims, 6 Drawing Sheets

(56) References Cited

U.S. PATENT DOCUMENTS

| | | | | |
|---|---|---|---|---|
| 4,830,218 | A | 5/1989 | Shirkhan | |
| 4,842,162 | A | 6/1989 | Merkel | |
| 4,848,657 | A | 7/1989 | Hashimoto et al. | |
| 4,850,514 | A | 7/1989 | Scholl et al. | |
| 4,883,691 | A | 11/1989 | McIntyre | |
| 4,922,852 | A | 5/1990 | Price | |
| 4,935,261 | A | 6/1990 | Srivastava et al. | |
| 4,988,015 | A | 1/1991 | Price | |
| 4,995,333 | A | 2/1991 | Keller et al. | |
| 5,016,665 | A | 5/1991 | Konieczynski | |
| 5,049,368 | A | 9/1991 | Turner | |
| 5,061,170 | A | 10/1991 | Allen et al. | |
| 5,065,695 | A * | 11/1991 | Baron et al. | 118/688 |
| 5,207,352 | A | 5/1993 | Porter et al. | |
| 5,228,594 | A | 7/1993 | Aslin | |
| 5,236,641 | A | 8/1993 | Allen et al. | |
| 5,263,608 | A | 11/1993 | Kiernan et al. | |
| 5,271,521 | A | 12/1993 | Noss et al. | |
| 5,307,288 | A | 4/1994 | Haines | |
| 5,316,836 | A | 5/1994 | Heindel et al. | |
| 5,332,125 | A | 7/1994 | Schmitkons et al. | |
| 5,342,647 | A | 8/1994 | Heindel et al. | |
| 5,401,353 | A | 3/1995 | Westbury et al. | |
| 5,413,651 | A | 5/1995 | Otruba | |
| 5,418,009 | A | 5/1995 | Raterman et al. | |
| 5,419,930 | A | 5/1995 | Schucker | |
| 5,423,935 | A | 6/1995 | Benecke et al. | |
| 5,443,678 | A | 8/1995 | Chevalier et al. | |
| 5,456,870 | A | 10/1995 | Bulgrin | |
| 5,462,199 | A | 10/1995 | Lenhardt | |
| 5,481,260 | A | 1/1996 | Buckler et al. | |
| 5,495,963 | A | 3/1996 | Miller et al. | |
| 5,520,958 | A | 5/1996 | Doesburg et al. | |
| 5,605,720 | A | 2/1997 | Allen et al. | |
| 5,645,639 | A | 7/1997 | Doesburg et al. | |
| 5,683,036 | A | 11/1997 | Benecke et al. | |
| 5,685,911 | A | 11/1997 | Raterman et al. | |
| 5,733,379 | A | 3/1998 | Schmitkons et al. | |
| 5,808,559 | A | 9/1998 | Buckler | |
| 5,857,589 | A * | 1/1999 | Cline et al. | 222/1 |
| 5,867,102 | A * | 2/1999 | Souder et al. | 340/572.8 |
| 5,881,914 | A | 3/1999 | Tsuda et al. | |
| 5,906,682 | A | 5/1999 | Bouras et al. | |
| 5,958,178 | A * | 9/1999 | Bartsch et al. | 156/543 |
| 5,984,148 | A | 11/1999 | Andel et al. | |
| 5,992,686 | A | 11/1999 | Cline et al. | |
| 5,995,909 | A * | 11/1999 | Bretmersky et al. | 702/50 |
| 5,999,106 | A | 12/1999 | Buckler | |
| 6,023,666 | A | 2/2000 | Jiang et al. | |
| 6,089,413 | A | 7/2000 | Riney et al. | |
| 6,139,903 | A | 10/2000 | Baron et al. | |
| 6,143,075 | A | 11/2000 | Osbon | |
| 6,161,723 | A | 12/2000 | Cline et al. | |
| 6,173,864 | B1 * | 1/2001 | Reighard et al. | 222/55 |
| 6,220,843 | B1 | 4/2001 | Allen | |
| 6,286,566 | B1 | 9/2001 | Cline et al. | |
| 6,328,832 | B1 | 12/2001 | Otruba et al. | |
| 6,329,013 | B1 | 12/2001 | Putt | |
| 6,422,428 | B1 | 7/2002 | Allen et al. | |
| 6,432,084 | B1 | 8/2002 | Levinson et al. | |
| 6,450,230 | B1 | 9/2002 | Otruba | |
| 6,499,987 | B1 | 12/2002 | Durina et al. | |
| 6,517,891 | B1 | 2/2003 | Estelle et al. | |
| 6,541,063 | B1 | 4/2003 | Prentice et al. | |
| 6,541,304 | B1 | 4/2003 | Bouras et al. | |
| 6,637,471 | B2 | 10/2003 | Luehrsen et al. | |
| 6,675,988 | B2 | 1/2004 | Cline et al. | |
| 6,712,906 | B2 | 3/2004 | Estelle et al. | |
| 6,752,323 | B1 | 6/2004 | Roos et al. | |
| 6,892,959 | B1 | 5/2005 | Fugere | |
| 6,913,166 | B2 | 7/2005 | Cline et al. | |
| 6,932,870 | B2 | 8/2005 | Gunn et al. | |
| 6,942,736 | B2 | 9/2005 | Chinander et al. | |
| 6,955,946 | B2 | 10/2005 | Bouras et al. | |
| 6,991,000 | B2 | 1/2006 | Jeter et al. | |
| 6,991,825 | B2 | 1/2006 | Hui et al. | |
| 7,101,439 | B2 | 9/2006 | Kushihashi et al. | |
| 7,112,246 | B2 | 9/2006 | Schucker | |
| 7,122,092 | B2 | 10/2006 | Poole et al. | |
| 7,198,073 | B2 | 4/2007 | Luehrsen et al. | |
| 7,204,960 | B2 | 4/2007 | Hui et al. | |
| 7,208,721 | B2 | 4/2007 | Valentin et al. | |
| 7,293,720 | B2 | 11/2007 | Ramsay | |
| 7,341,089 | B2 | 3/2008 | Puffe et al. | |
| 7,360,564 | B2 | 4/2008 | Engels et al. | |
| 7,465,264 | B2 | 12/2008 | Bomba | |
| 7,527,493 | B1 | 5/2009 | Durina | |
| 7,634,367 | B1 | 12/2009 | Ding et al. | |
| 7,770,760 | B2 | 8/2010 | McGuffey et al. | |
| 7,771,556 | B2 | 8/2010 | Fort et al. | |
| 7,789,111 | B2 | 9/2010 | Luehrsen et al. | |
| 7,874,456 | B2 | 1/2011 | Bolyard, Jr. et al. | |
| 7,963,954 | B2 | 6/2011 | Kavazov | |
| 7,967,168 | B2 | 6/2011 | Geier et al. | |
| 8,011,394 | B2 | 9/2011 | Luehrsen et al. | |
| 8,181,468 | B2 | 5/2012 | Fiske et al. | |
| 8,192,573 | B2 | 6/2012 | Leykamm | |
| 8,226,597 | B2 | 7/2012 | Jacobson et al. | |
| 8,231,566 | B2 | 7/2012 | Jacobson et al. | |
| 8,255,088 | B2 | 8/2012 | Burkus, II et al. | |
| 2003/0157251 | A1 * | 8/2003 | Mandai et al. | 427/350 |
| 2004/0159402 | A1 | 8/2004 | Poole et al. | |
| 2004/0161531 | A1 | 8/2004 | Ferber et al. | |
| 2004/0186621 | A1 | 9/2004 | Lewis et al. | |
| 2005/0048196 | A1 | 3/2005 | Yanagita et al. | |
| 2006/0175432 | A1 | 8/2006 | Brock et al. | |
| 2006/0289566 | A1 * | 12/2006 | Heerdt et al. | 222/146.5 |
| 2007/0017638 | A1 | 1/2007 | Moebius | |
| 2007/0029036 | A1 * | 2/2007 | Fort et al. | 156/291 |
| 2007/0235120 | A1 | 10/2007 | Poole et al. | |
| 2008/0014344 | A1 * | 1/2008 | Fort et al. | 427/207.1 |
| 2010/0147454 | A1 | 6/2010 | Leykamm | |
| 2010/0260531 | A1 | 10/2010 | Rademacher | |
| 2012/0031326 | A1 | 2/2012 | Wu et al. | |
| 2012/0040477 | A1 | 2/2012 | Yu et al. | |

FOREIGN PATENT DOCUMENTS

| | | |
|---|---|---|
| JP | 2005144358 | 6/2005 |
| JP | 3731912 | 1/2006 |
| WO | WO2005/115847 | 12/2005 |
| WO | 2007005396 A1 | 1/2007 |
| WO | WO2008/078044 | 7/2008 |
| WO | WO2009/071237 | 6/2009 |

OTHER PUBLICATIONS

Nordson, PatternCoat Slot Gun, Adjustable-width slot gun delivers production efficiency in magazine-fed labeling applications with frequent label format changes, Sep. 2007, pp. 1-2.

Marathon Overview, 5 Servo Axes on XL/XLA (4 Servo Axes on SL/SLA), 2004.

Webflight, Webflight Micro-Control Coating Technology, 2006.

Robatech Gluing Technology, Hotmelt Applicator Heads SX/AX Bead and Dot Applications, 2008.

Robatech Gluing Technology, Nozzle Application System, Wrap-Around Labeling, 2008.

International Searching Authority, The International Search Report and the Written Opinion of the International Searching Authority for the corresponding PCT Application No. PCT/US2011/030462 mailed Jun. 30, 2011.

* cited by examiner

EXTRUSION APPLICATION SYSTEM

CROSS REFERENCE TO RELATED APPLICATION

This application claims the benefit of U.S. provisional Application No. 61/319,960, filed Apr. 1, 2010.

TECHNICAL FIELD

This disclosure relates to precision fluid application systems.

BACKGROUND

Applicator systems are used in a wide variety of manufacturing operations to apply compositions such as glue. For example, glue application systems are used in bottle labeling, can labeling, corrugated box making, manufacturing disposable diapers, and manufacturing other products that involve the application of glue.

Hot melt glue is one type of glue that is particularly well suited for applications where it is desired to apply glue at a high rate of speed. Applicants' assignee, B & H Manufacturing Company, Inc., provides labeling machines with a glue application system in which a glue wheel is provided with hot melt glue that is applied to a knurled roller and scraped off with a doctor blade in a process that is comparable to a gravure printing process.

While this system generally provides a reliable system for applying glue to labels at a high rate of speed, issues remain that relate to precise control of glue quantity, consistency of glue properties and minimizing the volume of glue required to secure a label. In addition, if the system is not properly set-up and maintained, glue splatter may result in application of glue to the vacuum drum that supports labels and the surrounding area. The removal of glue splatter may require periodic cleaning with solvents and may result in machine downtime. Recirculation of large volumes of hot melt glue from the glue wheel type applicator results in repeatedly reheating a substantial quantity of the glue which may adversely affect glue properties. In addition, exposure of the glue to air on a glue wheel may result in degradation of the adhesive properties of the glue.

One alternative approach is disclosed in US2008/0014344A1 that suggests spraying a container with hot melt glue to adhere a leading end of a label from a cut and stack label magazine or a roll fed labeler to the container. Hot melt glue was proposed to be wiped onto the trailing edge of the label by a slit die nozzle that directly contacts the label to apply glue to the trailing edge that is then attached to the container or the label. A problem with this approach is that glue is extruded from the nozzle and "waits" on the head until the glue is smeared onto the trailing edge of the label material. A lack of control over the quantity of glue laid down on the label, or lay down weight, results in variation in the glue lay down weight as labeling speeds increase. This system fails to provide a method of controlling the lay down weight at variable speeds and is believed to have been limited to systems that apply labels at a rate of no more than about 300 containers per minute. When the slit die nozzle for hot melt glue application directly contacts the label, particularly with thinner labels, the label may be wrinkled or otherwise distorted. Another problem with this proposed approach is that the spring that is used to contact the slot gun with the trailing edge pad does not compensate for increases in centrifugal forces as labeling speeds increase which results in an increase in the contact force that may damage the trailing edge pad. Another problem is that may arise from variation in lay down weight is that the label may become jammed in the machine or otherwise misapplied to the container.

In other approaches, glue is provided to the slit die nozzle at a pressure that is controlled with the objective of maintaining a constant pressure level. However, as a valve is opened and closed to apply the glue an uneven distribution of glue is applied to the label. Another strategy for applying glue is to control the volume of glue applied by changing the speed of the glue pump in an effort to maintain a constant pressure. One problem with this approach is that it may result in an intermittent pattern of pressure spikes and thickness variation in the adhesive deposits. Another problem with this approach is that the quantity of glue applied is subject to variation.

Continuous application of an adhesive to a web of a plastic substrate in the manufacture of adhesive tape or pressure sensitive label material may be performed with a slit die coating nozzle that is controlled by controlling the volumetric flow of adhesive to a web that is continuous and moving at a constant rate of speed. However, volumetric control does not yield consistent and reliable application of glue with a controlled thickness when the speed of application changes. The glue is a compressible non-Newtonian liquid which renders volumetric control unreliable because it does not compensate for internal friction, the Reynolds number for the passages, changing viscosity and changes in shear strength caused by the speed of flow of the glue.

Others have proposed various solutions to improve upon the performance of the glue wheel approach. It should be understood that all alternative prior art approaches are not attempted to be described above. Applicants' development addresses the above issues and other issues relating to applying hot melt glue or otherwise extruding a non-Newtonian fluid onto a substrate through a nozzle. Applicants' development may be adapted to a wide variety of applications that are not limited to container labeling applications or the application of hot melt glue.

Some aspects of the developments are summarized below in greater detail.

SUMMARY

According to the present invention, an applicator is disclosed that is capable of accurately applying a consistent volume of a non-Newtonian liquid composition with consistent thickness to a substrate at a widely varying rate of speed of the extrusion. A non-Newtonian liquid composition is a liquid that does not flow in the same way as a Newtonian fluid, such as water. More particularly, the viscosity of non-Newtonian fluids is not independent of shear rate. As a result, viscosity is not constant which complicates controlling flow volumetrically. The disclosed application system variably controls pressure based upon the temperature, speed of extrusion and the flow characteristics of the composition. Pressure is modulated at a given temperature of the composition as a function of the speed of the extrusion to obtain desired target deposit thickness and consistent lay down weights.

Examples of non-Newtonian liquid compositions include liquid plastic compositions such as polymer solutions, or molten polymers like hot melt glue. A selected liquid plastic composition is applied under pressure onto a surface by way of a nozzle. The liquid plastic composition may be applied without touching the surface with the nozzle. The adhesive is extruded in a controlled volume and at a consistent thickness in at least one predefined region on the surface.

Another aspect of this development relates to the concept of controlling the pressure of the liquid plastic composition supplied to an extrusion nozzle. Pressure is controlled based upon empirical data relating the volume of a specified composition applied over time. A controlled volume of the composition is applied to a surface through a nozzle. The pressure of the composition within the nozzle is closely controlled based upon the rate at which the composition is dispensed from the nozzle.

Application of the adhesive to a label, or segmented substrate, is based upon controlling the sensed pressure of the adhesive in the applicator, and label segment position data. The sensed pressure in the applicator and the output of a positional encoder are inputs for a servo motor controller for a fluid pump. A valve controls the timing of the deposit of adhesive onto the surface. Data from a look up table, or data matrix, may be provided to the processor to vary the quantity of adhesive based upon known or estimated values for the rate of application and pressure in the applicator. According to the method, a consistent volume of adhesive is applied to the label, or segmented substrate, surface in precise locations with consistent thickness.

The pressure of the liquid plastic composition may be modulated at the inlet of the slit die nozzle. The system may be adjusted by referencing a data table for a particular liquid plastic composition having certain flow properties. A self-adjusting system may be provided for applying a deposit of liquid plastic composition with a uniform thickness to a surface. According to the method, changes in the speed of intermittent extrusion do not cause variation in the thickness of the deposits.

The slit die nozzle in the disclosed system may be oriented with the slit of the nozzle being elongated in the vertical, horizontal or in any other orientation.

Another aspect of the disclosure is related to providing a labeling machine that has a rigid all metal vacuum drum that has rigid metal pads at selected locations on a vertically oriented surface of the vacuum drum. The rigid metal pads are radially adjustable to provide precise spacing relative to a vertically oriented slit nozzle adhesive applicator.

Another aspect of the disclosure is to provide a roll fed labeler that is capable of reliably applying a hot melt adhesive having a viscosity of more than 1,300 centipoises per second (cps). Hot melt adhesives having a viscosity of more than 10,000 centipoises have been successfully applied that offer favorable adhesive properties but were previously not considered to be usable in high speed labeling operations. The applicator facilitates the use of more economical glues that may have improved adhesion and strength properties.

Other aspects of applicants' development as disclosed herein will be apparent to one of ordinary skill in the art of labeling containers or manufacturing products that require precise application of adhesives. More generally, the applicants' developments may permit more effective and efficient application of a liquid plastic composition by providing a controlled volume of the composition having the desired strength characteristics for a specific application.

One aspect of this invention is to provide a machine that applies a non-Newtonian liquid composition in a controlled pattern of deposits to a surface. The composition may be hot melt glue or may be another type of liquid plastic composition that must be carefully applied in a predetermined pattern or in a full coating to a surface. The machine in the illustrated embodiment is a labeling machine but the technology may also be used in other machines that apply a non-Newtonian liquid composition to a surface.

In one example of a machine for applying a non-Newtonian liquid composition, hot melt glue may be applied to a label segment. The composition is received through an inlet and is dispensed through an outlet of a nozzle that deposits a controlled layer of the composition on the surface as the surface moves relative to the nozzle. A valve has an inlet that receives the composition from a pressurized source and is provided to control dispensing the composition through the nozzle outlet. A pressure transducer measures the pressure of the composition at the valve inlet and generates a signal representative of the pressure. A temperature sensor measures the temperature of the composition and provides a temperature signal. The machine has a logic circuit that controls the operation of the valve and an output that controls the pressure. The logic circuit uses inputs such as the signal representative of pressure, temperature of the composition, the location of the surface, the speed that the surface is moving relative to the nozzle to apply the composition in a controlled manner, and a fluid flow profile that provides for a given temperature and number of surfaces receiving a layer or the containers per minute determines the output that controls the pressure.

In another example of the machine for applying a composition, the machine, as described above, utilizes inputs that relate to the characteristics of the composition that include correlation data that correlates the speed of movement of the surface with the pressure of the composition.

Another aspect of the machine for applying a liquid plastic composition to a surface, the chamber may have a return conduit that provides a return flow path from the chamber to a reservoir. The return conduit may have a fixed metering orifice that partially restricts the flow of the composition through the return conduit. The metering orifice facilitates control of the pressure of the liquid plastic composition. A limited volume of adhesive is returned to the adhesive reservoir through the orifice, which is located downstream of the nozzle.

The invention may also be characterized as a method of dispensing a liquid plastic composition onto a surface. The method includes the steps of selecting the composition to be dispensed through a nozzle while the surface moves relative to the nozzle. The speed of the surface is determined, correlation data is referenced and variable pressure levels are used to control the rate of displacement of the composition from the chamber. The pressure applied to the composition is measured and compared to the variable pressure value level to adjust the rate of displacement of a supply pump for the composition. A deposit of the composition is intermittently released from the nozzle by a valve that is timed based in part upon the speed with which the surface moves relative to the nozzle, a data matrix of the fluid flow characteristics including the rate of fluid flow within a range of temperatures and a range of pressure levels.

The method of the present invention may also include empirically testing the composition to develop a pressure look-up table that includes correlation data for a plurality of speeds and a plurality of pressure set-points. Alternatively, correlation data may be provided from a pressure look up table that is generated by an algorithm. The algorithm for controlling pressure may use a direct feedback system that measures the actual thickness of the deposits. The direct feedback system may incorporate a laser measurement apparatus.

These and other features, objects and aspects of the invention will be better understood in view of the attached drawings and the following detailed description of the illustrated embodiments of the invention provided below.

DETAILED DESCRIPTION

As required, detailed embodiments of the present invention are disclosed below with reference to the drawings. However, it is to be understood that the disclosed embodiments are merely exemplary of the invention that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
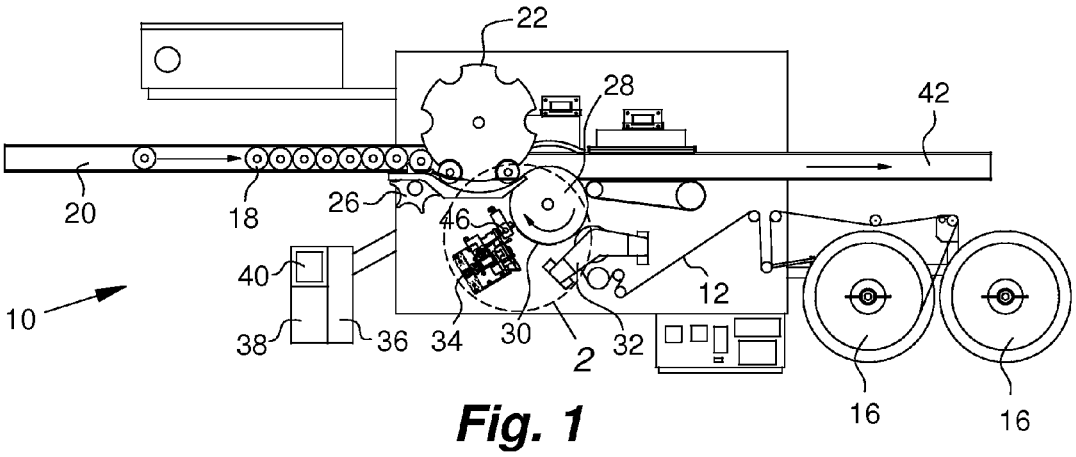
FIG. 1 is a top plan view of a container labeling machine that is provided with a liquid plastic composition applicator.

Referring to FIG. 1, a labeling machine 10 is illustrated to show one example of a manufacturing process that may benefit from Applicants' developments. It should be understood that other manufacturing or packaging systems that include non-Newtonian liquid composition application operations may also benefit from the method and apparatus disclosed in this patent application.

In the illustrated labeling machine 10, a web of label material 12 is provided in the form of a roll 16 to labeling machine 10. A stream of containers 18 is provided to the labeling machine 10 on an in-feed conveyor 20. The containers 18 are fed to a star wheel 22 that picks up the containers 18 and spaces the containers 18 from each other for labeling. An idler wheel 26 cooperates with the star wheel 22 to ensure proper positioning of the containers 18 in the star wheel 22 as the containers 18 are moved by the star wheel 22 toward the vacuum drum 28. A liquid plastic composition, for example, hot melt glue or another adhesive is applied to the label 30.

Figure 7:
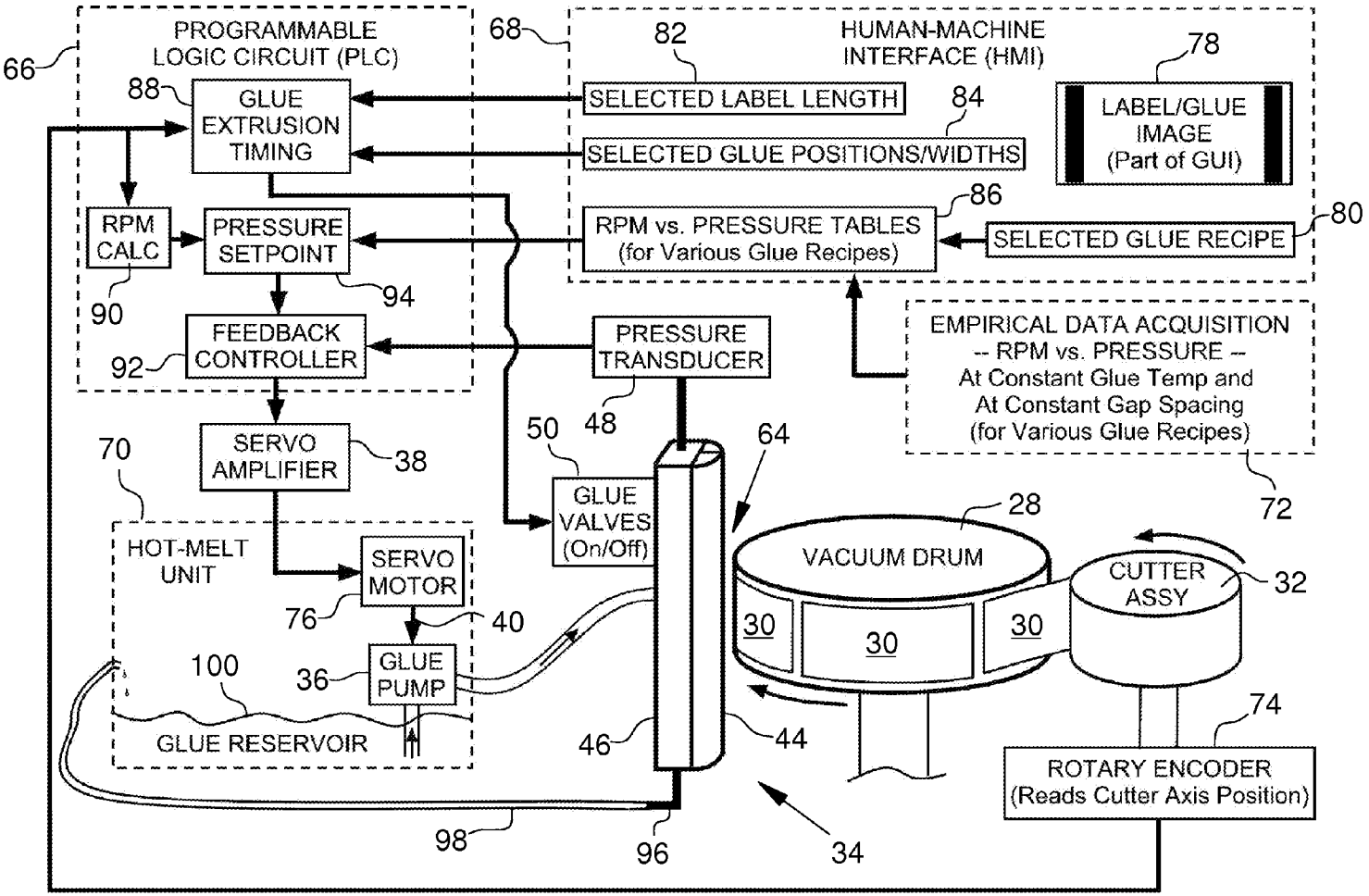
FIG. 7 is a high-level system flowchart depicting the controls and processes by which liquid plastic composition is applied to discrete labels by way of a slit die glue applicator.

The star wheel 22 feeds the containers 18 to a location adjacent to a vacuum drum 28. The vacuum drum 28 holds one or more discrete labels 30 after they are cut off from the web of label material 12 by a cutter assembly 32. The vacuum drum 28 holds the labels 30 in position as the labels are transferred by the vacuum drum 28 past a hot melt glue applicator 34. Turning now to FIG. 7 for illustration, the glue applicator 34 is supplied with hot melt glue from a glue pump 36. The glue pump 36 is precisely controlled by a servo amplifier 38 that is connected by a servo motor 76 through a gear reducer 40 to the glue pump 36. Depending upon the requirements of the manufacturing or labeling system, glue is applied to the label 30 near the leading edge 54 and trailing edge 56 (see, for example, FIG. 9), on the entire surface of the label 30, or in discrete deposits. Application of glue to the entire surface, as would be used to make a pressure sensitive label, is not illustrated because it would cover the entire surface and would appear the same as the label 30 shown in FIG. 4.

Returning to FIG. 1, the illustrated embodiment is a roll fed labeling machine 10. However, it should be understood that Applicants' developments are potentially applicable to labeling machines that use cut and stack labels, pressure sensitive labels, or other types of labels. In addition, Applicants' developments may be applicable to general manufacturing operations or other applications such as corrugated box manufacture where glue is applied to a surface.

Figure 2:
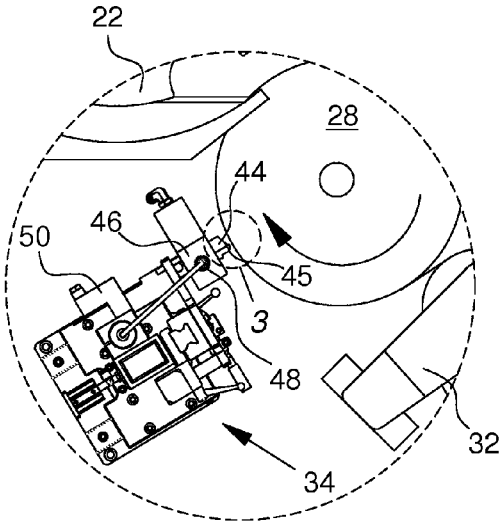
FIG. 2 is a fragmentary enlarged view of the portion of the labeling machine of FIG. 1 taken at the circle 2 in FIG. 1.
Figure 3:
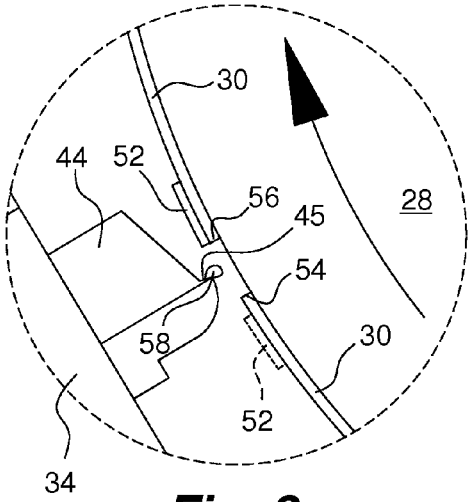
FIG. 3 is a fragmentary enlarged view of the portion of the labeling machine of FIG. 1 taken at the circle 3 in FIG. 2.

Referring to FIGS. 2 and 3, an interface between the glue applicator 34 and vacuum drum 28 will be explained in greater detail. The glue applicator 34 dispenses glue from a slit die nozzle 44. The slit die nozzle 44 has an elongated slit 45 that extrudes the composition to be dispensed. The slit 45, as illustrated, is vertically elongated to apply a layer of the composition to a label 30 while the label 30 is held on the vertical, cylindrical side of the vacuum drum 28. Precise control of the pressure of the composition results in consistent application of the composition regardless of the orientation of the slit die nozzle 44.

Glue is provided to the slit die nozzle 44 through a glue chamber 46 defined within the glue applicator 34. Alternatively, the chamber 46 could be eliminated and the glue could be supplied to a valve, such as a solenoid valve 50. A pressure transducer 48 is provided to measure the pressure of the glue in the glue chamber 46 or upstream from the valve 50. The glue chamber 46 may be in the nature of a rigid manifold. The pressure transducer 48 is a high temperature pressure transducer that is capable of measuring the pressure within the glue chamber 46 or upstream from the valve 50. The glue applicator 34 includes a plurality of solenoid valves 50 that function as on/off control gates for the hot melt glue. The solenoids 50 are controlled by a programmable logic controller (PLC) 66 that receives position data from the encoder 74 and pressure inputs from the pressure transducer 48. The encoder may be, for example, a linear or rotary encoder which allows a processor to determine the position of a label as the label is moved relative to the nozzle 44 of a glue applicator 34. The label is preferably maintained in a spaced relationship relative to the nozzle 44. Control of the glue application operation will be described more specifically below.

Referring to FIG. 3, the glue applicator 34 and the slit die nozzle 44 are shown in conjunction with the vacuum drum 28.

Two labels 30 are partially shown as they are supported on the vacuum drum 28. An adhesive deposit 52 is shown near the trailing edge 56 of one label 30. In phantom lines, a glue deposit 52 is shown where it will be placed near the leading edge 54 of a second label segment 30. A bead of glue 58 is extruded from the slit die nozzle 44. As the label 30 with the glue deposit 52 shown in phantom lines passes by the slit die nozzle 44, the bead of glue 58 contacts the label 30 near the leading edge 54 and the bead of glue is applied as an extruded film on the label 30.

Figure 4:
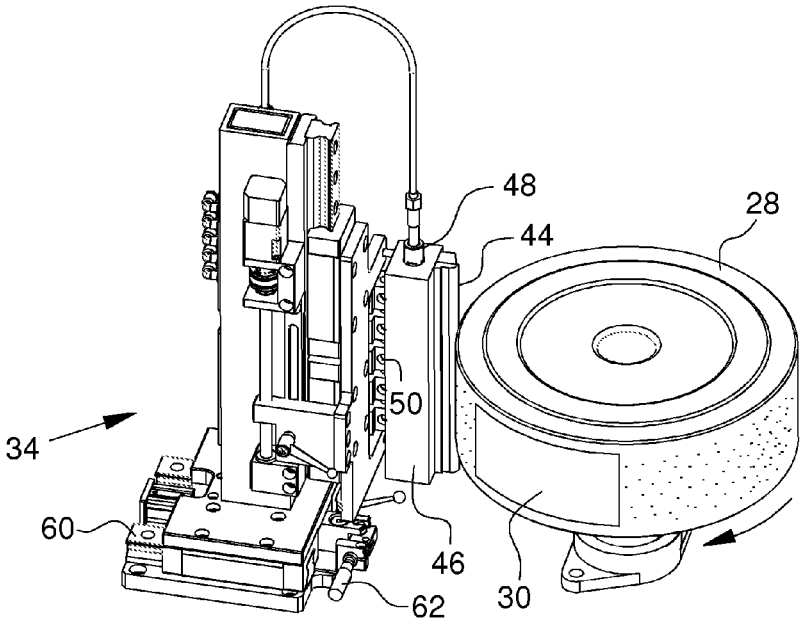
FIG. 4 is a perspective view of a glue applicator and a vacuum drum.

Referring to FIG. 4, the glue applicator 34 and vacuum drum 28 are shown in isolation. The spacing between the nozzle 34 and the vacuum drum 28 is held constant. Generally, the spacing between the nozzles 34 and the label 30 should be between 0.0005 inches 0.002 inches.

Pressure is maintained within the glue chamber 46, in part, by providing a fixed metering outlet orifice 96 (see, for example, FIG. 7) in association with an outlet port of the glue chamber 46 through which a small portion of the glue is returned to the glue reservoir 100. The fixed metering outlet orifice in one embodiment is 0.015 inches in diameter. However, it should be understood that the size of the fixed orifice may be changed. The glue applicator 34 is mounted to a positioning slide 60 that is used to set the spacing between the glue applicator 34 and the vacuum drum 28. A positioning lock 62 is provided as part of the positioning slide 60 that functions to lock the glue applicator 34 in a desired location on the positioning slide 60.

Figure 5:
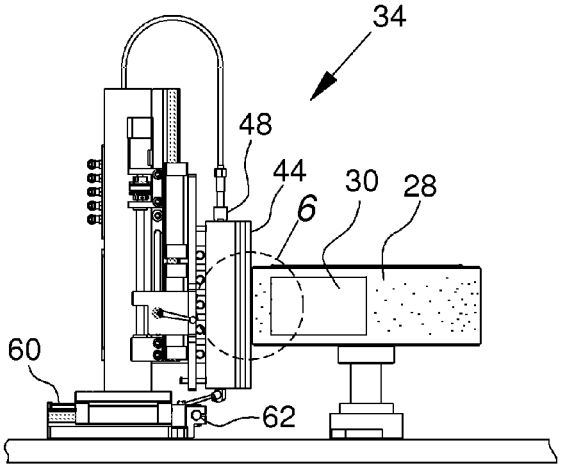
FIG. 5 is an elevation view of the glue applicator and the vacuum drum.
Figure 6:
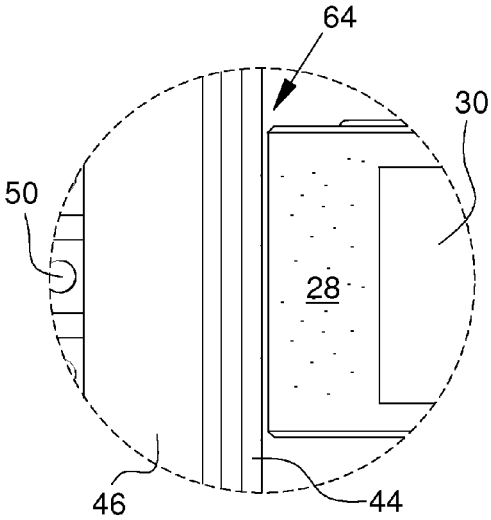
FIG. 6 is a fragmentary enlarged view of the portion of the glue applicator and the vacuum drum of FIG. 5 taken at the circle 6 in FIG. 5.

Referring to FIGS. 5 and 6, the glue applicator 34 is precisely located relative to the vacuum drum 28 so that a gap 64 is maintained between vacuum drum 28 and the slit die nozzle 44.

Referring now to FIG. 7, a high-level system flowchart is depicted including the processes by which hot melt glue is applied to discrete labels 30 by way of glue applicator 34. A human-machine interface (HMI) 68 provides the operator the ability to input, for example, the selected label length 82, the selected positions and widths 84 of the glue deposits on the label 30, and the selected glue recipe 80. The HMI 68 may include a label/glue image 78 as part of a graphical user interface (GUI). The appropriate glue application pressure and timing are then controlled by the applicants' method without further operator input, regardless of the line speed (containers per minute) selected by the operator.

Figure 9:
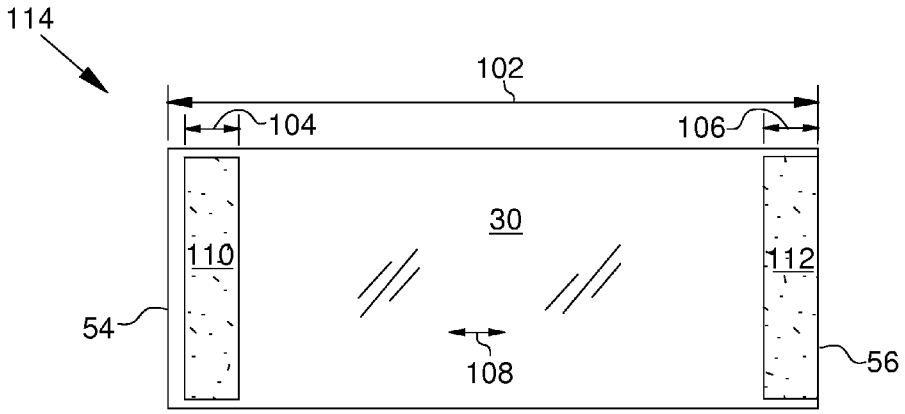
FIG. 9 is a front view of a discrete label with a first glue deposit and a second glue deposit applied thereto.

FIG. 9 provides a depiction of a processed label 114, which includes a first glue deposit 110 and a second glue deposit 112, each having been applied to label 30 at positions along the longitudinal direction 108. Label 30 is not shown to scale. Label 30 has a length 102, a leading edge 54 and a trailing edge 56. The first glue deposit has a first glue deposit width 104 and the second deposit has a second glue deposit width 106. If desired, the complete label can be covered by a glue deposit.

Returning now to FIG. 7, a rotary encoder 74 reads the position of the cutter assembly 32 while the labeling machine 10 is in operation. A single 360-degree rotation of the axis of the cutter assembly 32 translates into the length of a single label 30. The position data from the rotary encoder 74, and the selected label length 82 and selected glue positions and widths 84, are fed into a glue extrusion timing 88 portion of a programmable logic controller (PLC) 66. The glue extrusion timing 88 determines and sends the appropriate on/off commands to the glue valves 50.

The pressure within the glue chamber 46 is tightly controlled by way of a feedback controller 92 established in the PLC or other computing device. Feedback controller 92 operates within the PLC 66 or other computing device, and runs a control loop in which the pressure set point 94 is determined by matching an RPM calculation 90 with the corresponding pressure listed in RPM versus pressure tables 86. The RPM calculation 90 relies on the rotary position data from the rotary encoder 74, and is therefore dependent upon the operating speed of the labeling machine (in containers per minute). The RPM value with a rotary cutter assembly 32 that cuts one label per rotation is the same as a value of the number of substrates to which the glue is applied per minute. The particular RPM versus pressure table from which the pressure set point 94 is selected is generally unique to the selected glue recipe 80. The RPM versus pressure tables 86 are typically generated prior to the operational use of the labeling machine by way of an empirical data acquisition process 72, and generally uploaded into the HMI 68.

The pressure transducer 48 reads the pressure in the glue chamber 46. In systems that do not have a chamber, the pressure transducer 48 would read the pressure at the inlet of the valves 50. The feedback controller 92 compares the pressure set point 94 to the pressure measured by the pressure transducer 48. If the measured pressure is below the pressure set point 94, the feedback controller 92 will send commands to the servo amplifier 38 to increase the speed of the servo motor 76 in the hot melt unit 70. Increasing the speed of the servo motor 76 increases the speed of the glue pump 36 and, consequentially, increases glue pressure downstream in the glue chamber 46. Conversely, if the measured pressure is above the pressure set point 94, the feedback controller 92 will send commands to the servo amplifier 38 to decrease the speed of the servo motor 76. Decreasing the speed of the servo motor 76 reduces the speed of the glue pump 36 and, consequentially, decreases the glue pressure downstream in the glue chamber 46.

Figure 8:
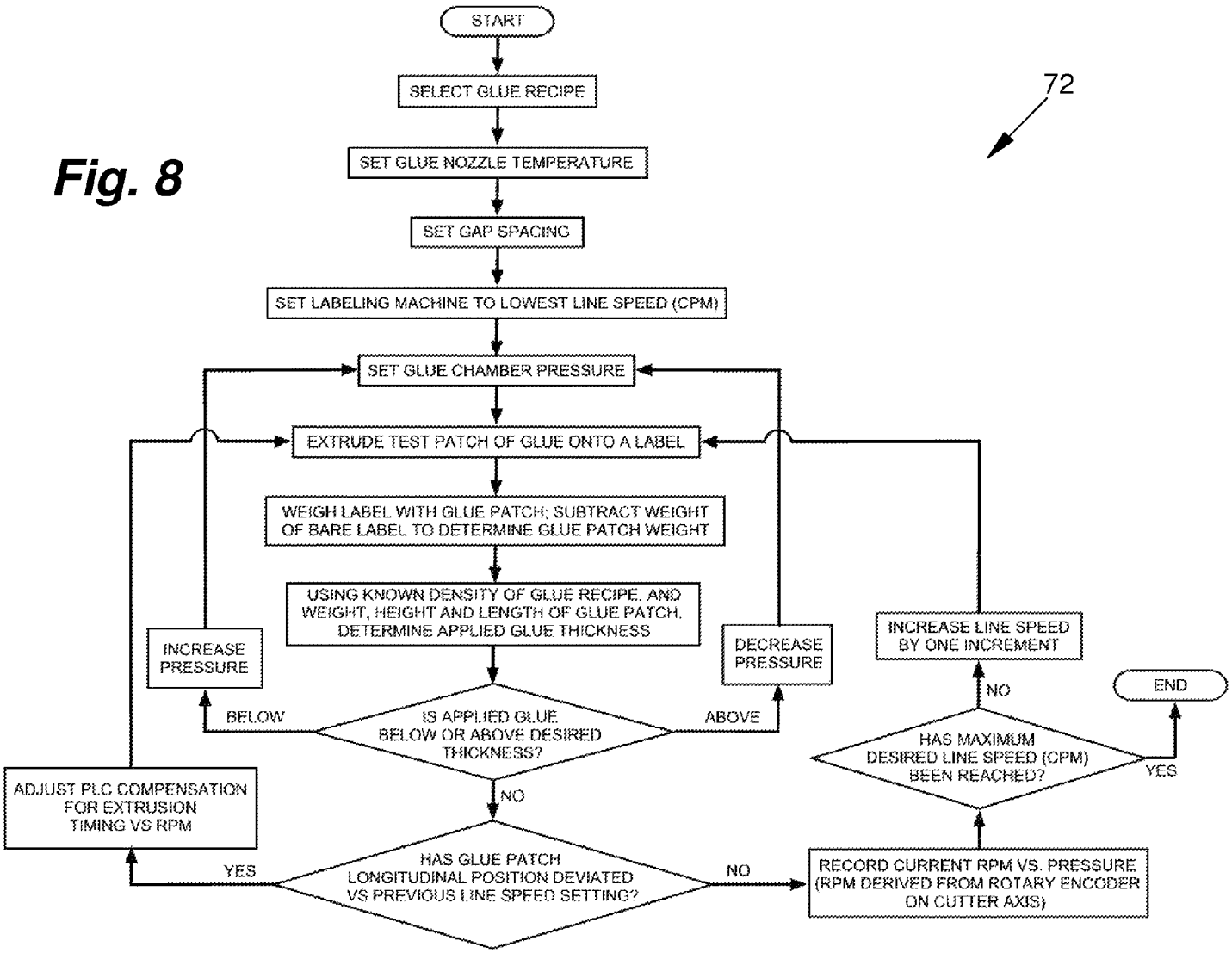
FIG. 8 is a flowchart depicting an empirical data acquisition process whereby data can be collected for use in controlling the application of liquid plastic composition to labels by way of a slit die glue applicator.

Turning now to FIG. 8, an example of an empirical data acquisition process 72 is depicted in greater detail. The empirical data acquisition process 72 may be run for one or more different glue recipes. The glue recipe is selected, and the glue nozzle temperature and spacing of the gap 64 are set. The labeling machine 10 is then initially set to a lowest line speed, typically sixty containers per minute (CPM), and the glue chamber 46 is set to an initial pressure. With the labeling machine running, a test deposit of glue is extruded onto a label 30. The label with the glue deposit is then weighed, and the known weight of the bare label 30 is subtracted to determine the weight of the applied glue deposit. Using the known density of the glue recipe, and the weight, width and length of the glue deposit, the applied glue thickness is determined.

If the applied glue is determined to be below desired thickness, the pressure in the glue chamber 46 is increased, and the process returns to the extrusion of another test deposit of glue onto a label. If the applied glue is determined to be above desired thickness, the pressure in the glue chamber is decreased, and the process also returns to the extrusion of another test deposit of glue onto a label.

An algorithm may be used with a CCD laser measurement apparatus to either dynamically set the pressure in the chamber or develop a table of pressure values based upon available inputs. The laser measurement apparatus may measure the thickness of the deposit layer that is then used in a direct feedback system.

If the applied glue is neither below nor above the desire glue thickness, a determination is then made as to whether the longitudinal position of the glue deposit (for example, along longitudinal direction 108 in FIG. 9) has deviated compared to the position of the deposit applied with the previous line speed setting. If such a deviation has occurred, an extrusion timing versus RPM compensation adjustment is made to the glue extrusion timing 88 portion of the PLC 66 (see FIG. 7), and the process 72 returns to the extrusion of another test deposit onto a label 30 without increasing the machine speed, in order to verify the accuracy of the compensation adjustment.

Once glue deposit positional deviation is no longer occurring as a result of line speed change, the RPM (derived from rotary encoder 74 data) versus the glue chamber 46 pressure is recorded. If a single label segment is cut per RPM, there is a direct relationship of the number of cutter RPM to the number of substrates that are provided with glue per minute. If maximum desired line speed has not been reached, the line speed is increased by one increment, and the process returns to the extrusion of a test deposit of glue onto a label. If maximum line speed has been reached, the empirical data acquisition process 72 is generally terminated with respect to the selected glue recipe. The records of RPM versus pressure are then generally arranged in look-up tables corresponding to each glue recipe tested, and input into the HMI 68 (see FIG. 7) as RPM versus pressure tables 86.

In further embodiments, the empirical data acquisition process 72 for each glue recipe is attempted at lower glue temperatures. Applicants have determined that applying glue to labels at lower temperatures preserves the adhesive properties of the glue by, for example, minimizing temperature-related breakdown of the adhesive chemistry. Since lowering the glue temperature at the slit die nozzle 44 is likely to affect the flow properties of the glue, lowering the glue nozzle temperature also tend to change the results of the empirical data acquisition process 72 for a given glue recipe. As a result, the RPM versus pressure tables 86 for each glue recipe may depend on the operating temperature of the slit die nozzle 44.

Figure 10:
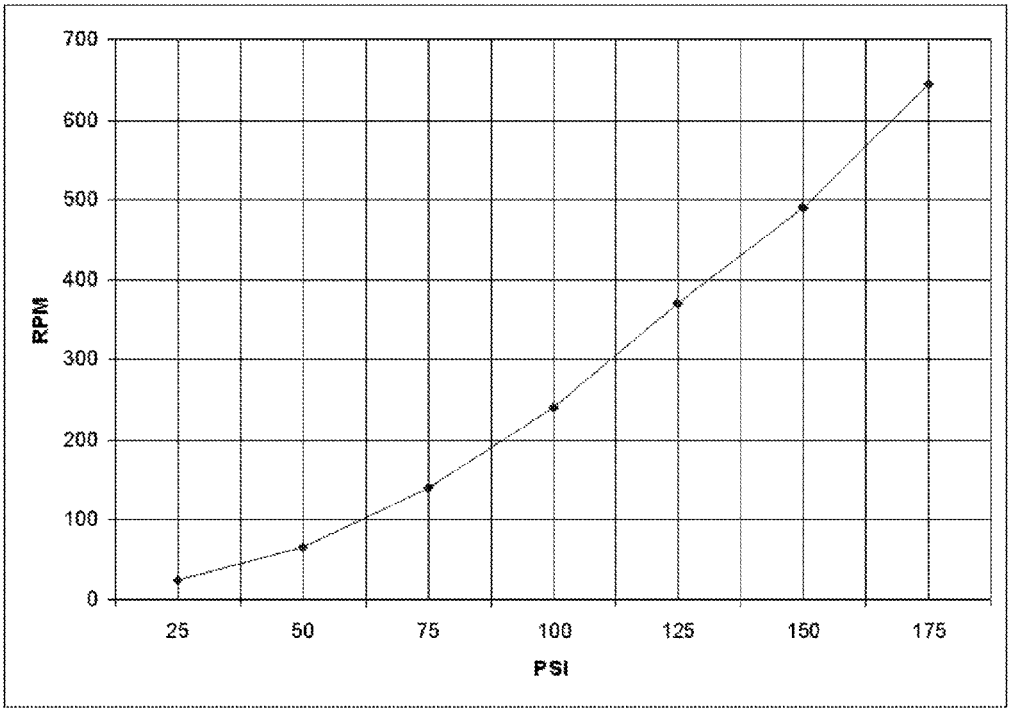
FIG. 10 illustrates a chart generated using empirical data acquired by way of a data acquisition process similar to that described in the flowchart of FIG. 8.

Applicants have found that the plotting of the RPM versus pressure data for a given glue recipe at a constant temperature and gap distance commonly results in a curved graph similar to that shown in FIG. 10. The curve tends to vary primarily depending upon the glue recipe and slit die nozzle temperature. Further, some of the applicants' tests have shown that, in some instances with particular glues, such curves can be approximated as a straight line with a constant slope without significantly impacting the results of the glue application method at varying line speeds. For example, applicants have performed tests using one particular glue, Henkel 132A, in which they were able to calculate appropriate glue chamber pressure setpoints for the control loop using the formula: $T=(A-80)*0.6+p$, where "T" was the pressure setpoint, "A" was the target line speed (containers per minute, starting at 80 CPM), and "p" was the initial pressure (50 psi).

Figure 11:
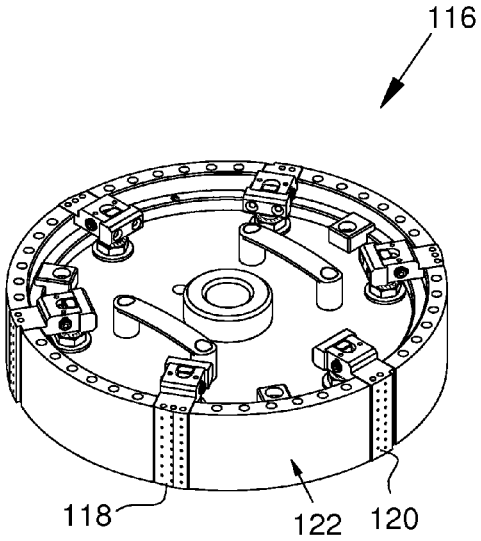
FIG. 11 is a perspective view of a subassembly of a further embodiment of a vacuum drum, depicting radially adjustable leading edge and trailing edge pads.
Figure 12:
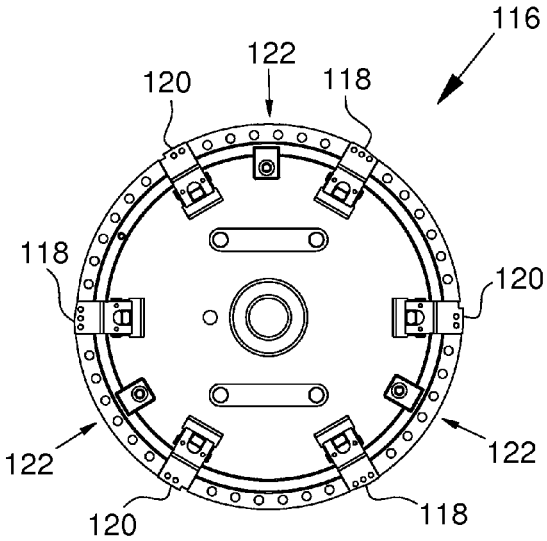
FIG. 12 is a top view of the subassembly shown in FIG. 11.

As illustrated in FIGS. 11 and 12, certain embodiments may include a vacuum drum 28 with an alternative subassembly 116 which includes leading edge pads 118 and trailing edge pads 120 that are each independently radially adjustable to ensure the consistency of the gap 64 spacing between the slit die nozzle 44 and the vacuum drum 28 including the leading and trailing edge pads 118 and 120. The version of the subassembly 116 illustrated in FIGS. 11 and 12 provides for a three-station vacuum drum in which the three label stations 122 are generally defined by the three cylindrical arcs each beginning on a leading edge pad 118 and ending on a trailing edge pad 120.

Figure 13:
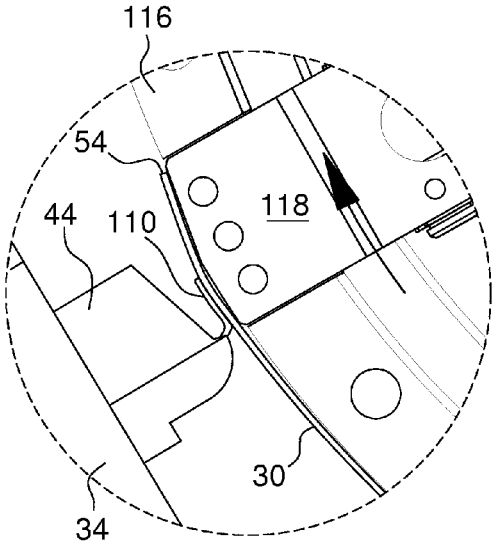
FIG. 13 is a fragmentary enlarged view similar to that of FIG. 3, but showing a portion of the vacuum drum subassembly shown in FIG. 12, and adhesive being applied near the leading edge of a label.
Figure 14:
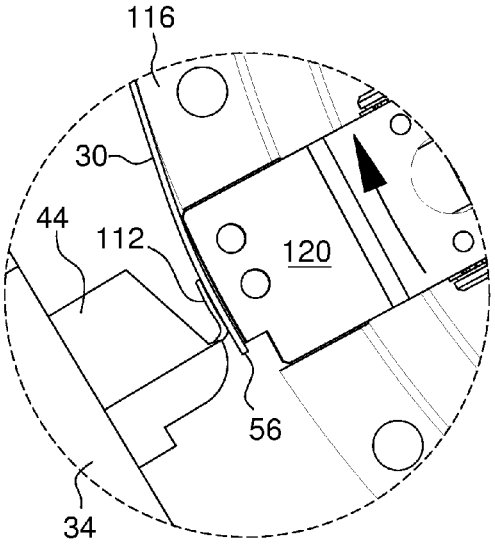
FIG. 14 is a fragmentary enlarged view, similar to that of FIG. 13, but with adhesive being applied near the trailing edge of a label.

FIG. 13 depicts the application of a first glue deposit 110 near the leading edge 54 of a label 30. The leading edge pad 118 is shown exposed from the top to illustrate a typical position of the leading edge pad 118 relative to the label 30. Similarly, FIG. 14 depicts the application of a second glue deposit 112 near the trailing edge 56 of a label 30. The trailing edge pad 120 is also shown exposed from the top to illustrate a typical position of the trailing edge pad 120 relative to the label 30. The precise control of the system enables application of layers of a non-Newtonian composition at any selected location or over an entire surface. The thickness of the glue deposits are substantially constant at any speed that the surface is moved by the machine. As used herein, the term "substantially constant" should be understood to be subject to a degree of variability but to be within about 10% of the thickness of the glue deposit.

While exemplary embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, the features of the various illustrated embodiments and other described variations may be combined to form further embodiments of the invention.

What is claimed is:

1. A method of extruding a controlled amount of a non-Newtonian fluid from a source of the non-Newtonian fluid, through a chamber of an applicator to a nozzle of the applicator, and through the nozzle of the applicator onto a substrate moving relative to the nozzle, comprising:

applying a predetermined pressure to the non-Newtonian fluid at a known temperature;

extruding the controlled amount of the non-Newtonian fluid, subject to the predetermined pressure, via an extrusion pathway through the chamber to the nozzle and through the nozzle onto the moving substrate; and redirecting a portion of the non-Newtonian fluid along a return pathway, independent of the extrusion pathway, from the chamber of the applicator to the source of the non-Newtonian fluid during extrusion of the controlled amount of non-Newtonian fluid in the extrusion step, wherein the predetermined pressure is based on empirical correlations of pressure applied to a calibration fluid, speed of a substrate relative to a nozzle during extrusion of the calibration fluid, and an amount of the calibration fluid extruded during an empirical data acquisition process performed independently of the extruding step.

2. The method of claim 1, wherein the applying act includes referencing a data matrix produced during the empirical data acquisition process that correlates data representative of a pressure applied to the calibration fluid, a speed of a substrate relative to a nozzle during extrusion of the calibration fluid, and an amount of the calibration fluid to be extruded, to select a predetermined pressure.

3. The method of claim 2 wherein the data matrix is created by recording data during the empirical data acquisition process representative of a measured amount of the calibration fluid deposited onto a substrate, a speed of a substrate relative to a nozzle during extrusion of the calibration fluid, and an applied pressure, for a plurality of amounts of the calibration fluid, speeds of substrates relative to nozzles during extrusion of the calibrated fluid, and applied pressures.

4. The method of claim 3 wherein the act of recording data representative of a measured amount of the calibration fluid deposited onto a substrate includes recording data that is representative of a weight of the calibration fluid deposited onto a substrate.

5. The method of claim 3 wherein the act of recording data representative of a measured amount of the calibration fluid deposited onto a substrate includes recording data that is representative of a thickness of the calibration fluid deposited onto a substrate.

6. The method of claim 1 wherein the non-Newtonian fluid is extruded onto a plurality of discrete moving substrates comprising:

designating a pattern to be applied to each of the substrates;

registering a location of each substrate relative to the nozzle; and controlling a valve that opens and closes to apply the non-Newtonian fluid through the nozzle to the substrates in the designated pattern.

7. The method of claim 6 wherein the substrates are labels and the pattern is a leading edge and trailing edge pattern.

8. The method of claim 1 wherein the act of applying a predetermined pressure includes applying a predetermined pressure to the non-Newtonian fluid at a location upstream of an inlet to the nozzle.

9. The method of claim 1 wherein the act of applying a predetermined pressure includes selecting the predetermined pressure by automatically generating the predetermined pressure.

10. The method of claim 1 further comprising measuring a pressure of the non-Newtonian fluid to establish a measured pressure, and modulating the pressure of the non-Newtonian fluid based upon a differential between the measured pressure and the predetermined pressure.

11. The method of claim 1 further comprising applying a new predetermined pressure to the non-Newtonian fluid in response to a change in speed of the substrate relative to the nozzle during extrusion of the controlled amount of the non-Newtonian fluid.

12. The method of claim 1 further comprising performing the data acquisition process to determine the empirical correlations of pressure applied to the calibration fluid, speed of a substrate relative to a nozzle during extrusion of the calibration fluid, and amount of the calibration fluid extruded.

13. The method of claim 1 wherein the return pathway extends from a valve of the applicator to the source.

14. The method of claim 1 wherein the return pathway comprises a fixed metering outlet orifice configured to partially restrict the flow of the non-Newtonian fluid through the return pathway.

15. The method of claim 1 wherein applying the predetermined pressure comprises adjusting the amount of pressure applied by a pump to the fluid.

16. The method of claim 15 wherein adjusting the amount of pressure applied by the pump to the fluid comprises adjusting the speed of the pump.

* * * * *